United States Patent [19]

MacDonald

[11] 4,424,728

[45] * Jan. 10, 1984

[54] ALLEN WRENCH HANDLE

[76] Inventor: Paul M. MacDonald, 17 Moors Cir., Scituate, Mass. 02066

[ * ] Notice: The portion of the term of this patent subsequent to Jan. 5, 1999 has been disclaimed.

[21] Appl. No.: 253,066

[22] Filed: Apr. 10, 1981

Related U.S. Application Data

[63] Continuation-in-part of Ser. No. 106,479, Dec. 26, 1979, Pat. No. 4,308,770.

[51] Int. Cl.[3] ..... B25B 13/00

[52] U.S. Cl. ..... 81/177 A

[58] Field of Search ..... 81/177 R, 177 A, 438; 279/14, 89, 93; 145/61 J

[56] References Cited

U.S. PATENT DOCUMENTS

| | | | |
|---|---|---|---|
| 1,753,441 | 4/1930 | Morehouse | 81/177 A X |
| 3,306,639 | 2/1967 | Lyon | 81/177 A X |
| 4,308,770 | 1/1982 | MacDonald | 81/177 A |

*Primary Examiner*—James G. Smith

*Attorney, Agent, or Firm*—Morse, Altman & Dacey

[57] ABSTRACT

A handle is provided for use with an Allen wrench by means of which leverage and grip on the wrench is improved and protection is provided in the event that the wrench should break during use. The handle is comprised of an elongated shank portion having an axial passage therein to receive the long end of the wrench. A head is provided at the end of the shank portion and formed with a recess perpendicular to and open to the shank passage to receive the short end of the wrench. A spring-loaded pivoted finger providing a toggle action is mounted in the head to hold the end of the wrench within the handle during operation thereof.

2 Claims, 5 Drawing Figures

10
12
14
16
18
19
20
22
24
26
28
30
32
34
36
38
40
42
44
46
48
50
52

ALLEN WRENCH HANDLE

CROSS-REFERENCE TO RELATED APPLICATION

This is a continuation-in-part of U.S. application Ser. No. 106,479 filed Dec. 26, 1979, now U.S. Pat. No. 4,308,770.

BACKGROUND OF THE INVENTION

1. Field of the Invention

This invention relates generally to hand tools and more particularly is directed towards a new and improved safety handle for use with Allen wrenches and similar L-shaped tools.

2. Description of the Prior Art

Allen wrenches have been in common use for a great many years and are employed in variety of assembly and repair procedures for turning Allen screws. Similar L-shaped tools may be fitted with sockets or other heads for various purposes. The wrench normally is of the same dimensions throughout and, in practice, is fabricated from a length of hexagonal cross-section stock steel rods that are bent into an L-shape. The resulting tool is somewhat slender and therefore difficult to use when applying pressure, particularly in the smaller sizes. Also, the long end of the tool tends to be somewhat short so as to provide insufficient leverage in many instances. A more serious drawback with the Allen wrench is that under excessive pressure the wrench will snap, usually at the bend. When the wrench snaps, often times pieces of metal will fly from the broken tool presenting a hazard to those in the immediate vicinity.

While various types of handles have been proposed for use with Allen wrenches, none of these has been proven to be entirely satisfactory from the standpoint of simplicity, safety, ease of changing tools and the like.

Accordingly, it is an object of the present invention to provide a new and improved handle for use with Allen wrenches and similar L-shaped tools.

Another object of this invention is to provide a handle for use with Allen wrenches and the like which allows for the quick and easy exchange of Allen wrenches of different sizes.

Another object of this invention is to provide a handle for an Allen wrench or the like which substantially fully encloses the wrench during use as a protection in the event of breakage of the wrench from excessive pressure applied thereto.

SUMMARY OF THE INVENTION

This invention features a handle for use with an Allen wrench or the like, comprised of an elongated shank portion formed with an axial passage therein open to at least one end of the shank to receive the long end of an Allen wrench inserted therein. A head mounted at the one end of the shank portion is formed with a socket open to the shank passage and to one side of the head to receive the short portion of the Allen wrench and to allow the driving tip thereof to extend from the side of the head. A spring-loaded finger in pivotally mounted to the head in a toggle action arrangement adjacent the open end of the socket to hold the wrench in place during use thereof.

DETAILED DESCRIPTION OF THE PREFERRED EMBODIMENTS

Figures 1, 2, 3, 4, 5:
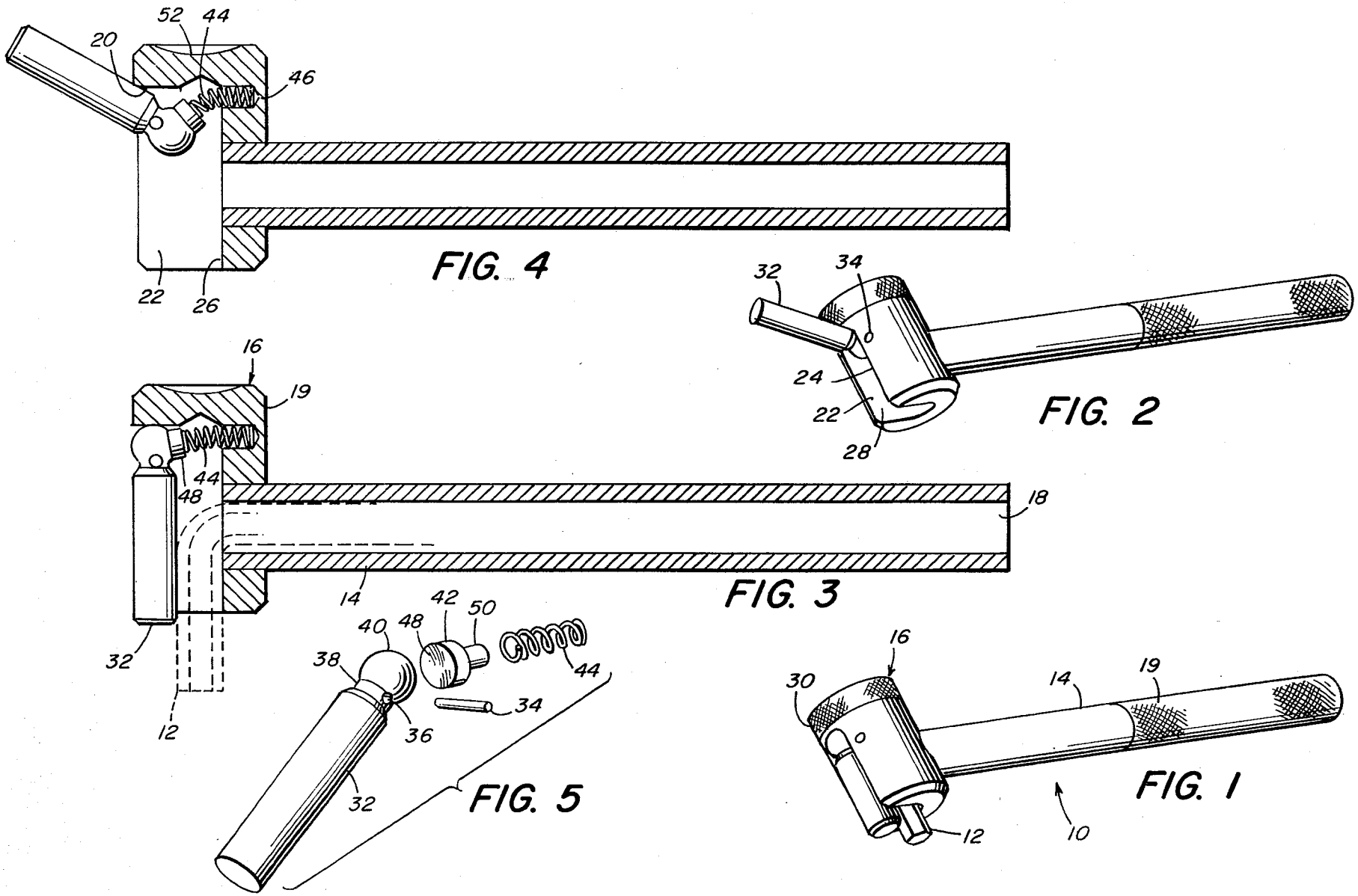
FIG. 1 is a perspective view of a handle made according to the invention shown with a wrench in place.
FIG. 2 is a view similar to FIG. 1 but showing the handle with the wrench removed.
FIG. 3 is a sectional view in side elevation of the handle with a wrench in place.
FIG. 4 is a view similar to FIG. 4 but with the wrench removed, and, FIG. 5 is an exploded perspective view of the spring loaded finger assembly used in the device.

Referring now to the drawings and to FIGS. 1 and 2 in particular, the reference character 10 generally indicates a handle for use with a standard Allen wrench 12 with the handle generally comprised of an elongated shank portion 14 and a head portion 16 at one end thereof. The handle may also be used with other L-shaped hand tools. The handle may be made up in a wide variety of different sizes depending upon the sizes of Allen wrenches to be used with it. However, by way of example, when using the handle with an Allen wrench having a length of about 3" on the long leg thereof, a handle 10 with an overall length of about 5" is employed. An Allen wrench in a 3" length typically is about 3/16" in diameter and has a short driving neck about 1" long.

The shank 14 and head 16 preferably are fabricated from a high strength metal and for this purpose aluminum, steel or brass may be used to advantage. Other high strength material such as certain strong, rigid plastics may also be employed. The shank portion is formed with an axial passage 18 extending over substantially the entire length thereof and may, if desired, extend the full length thereof. The depth of the passage in any event should be sufficient to accommodate the long end of an Allen wrench inserted therein and the width should similarly be dimensioned to accommodate a wrench of that size. For a handle intended for use with a wrench of the size indicated above, the depth of the passage should be $3\frac{1}{2}$ to 4" and its width should be on the order of $\frac{1}{4}$". Obviously, these dimensions are only by way of example and may be varied through a wide range depending upon the particular sizes of wrenches intended to be used with the handle.

The outer surface of the shank portion should provide a frictional grip and for this purpose the surface may be knurled, as illustrated at 19, grooved or ribbed or provided with some other type of textured finish to enhance the grip thereon.

The head 16 typically is generally cylindrical in shape although other configurations may also be used. The head may be fabricated integral with the shank portion or may be a separate piece attached to the end of the shank portion by means of press fitting the same thereon or by a screw fit in which the upper end of the shank portion as viewed in FIG. 1 is threaded about its outer end while the head is formed with a tapped socket to receive the threaded end of the shank portion.

In any event, the head 16 is formed with a rear wall 20 side walls 22 and 24 and a bottom wall 26 which define a socket 28 which is open at the end and at the side of the head to allow insertion and removal of an Allen wrench 12. Typically, the head 16 may be on the order of 1" in length in a handle 10 of the size described above. The head should be more or less centered on the end of the shank portion so that a rear portion 29 extends from the surface of the shank portion by a sufficient distance for the head to be gripped by the fingers for initial turning of the handle when starting to turn a screw into place. For this purpose the outer cylindrical surface of the head near the back wall may be knurled as indicated at 30 in FIG. 1.

The socket 28 in the above size typically extends about one inch from the open end to the back wall of the socket and has a depth of about ½" from the open side to the base of the socket to define a generally U-shaped socket the bottom wall of which is flush with the inner end of the shank portion as best shown in FIGS. 3 and 4. The width of the socket typically is about ¼" which is sufficient to accommodate the short end of the Allen wrench in several sizes.

The wrench 12 is held in position by means of a latch 32 pivoted near one end thereof by a pin 34 passing through the head 16 near the back wall of the socket and offset to one side from the passageway 18 to allow unimpeded movement of the wrench 12 when being placed in or removed from the handle with the latch in the open position. The latch 32 in the illustrated embodiment is generally cylindrical over most of its length and is formed with an opening 36 in a reduced neck portion 38 to receive the pin 34. The inner end of the latch forms into a ball 40 which rides against a cup 42 held by a compressed coil spring 44 at the rear of the socket. The right hand end of the spring 44 is seated in a cylindrical recess 46 in the rear of the socket. The action between the latch 32 and the spring is such that the latch may be snapped into either an open or a closed position.

The axis of the recess 46 is perpendicular to the length of the latch 32 when in the closed position of FIG. 3, thereby causing the spring 44 to apply counterclockwise closing pressure on the latch and against the wrench 12. In the open position of FIG. 4, the cup 42, which has a concave ball-engaging upper face 48, is tilted by the movement of the latch to the angle shown, thereby applying a clockwise pressure on the latch to hold it in an open position. The result is a toggle-like action which allows the latch to be snapped into either an open or closed position. The cup 42 is formed with a short stem 50 which extends into the top of the spring 44, holding the parts together when assembled. With the latch 32 open, the wrench 12 may be inserted in or removed from the handle. With the wrench in place, the latch is snapped down against the end of the wrench to hold it in place.

With the wrench in place it is held tightly and snugly within the handle with the driving tip of the wrench extending by a distance of perhaps ½" from the socket 28 sufficient to engage an Allen screw or the like with which the tool is being used. The long shank portion provides increased leverage and the relatively thick shank portion provides a much firmer and fuller grip to allow more pressure to be applied when needed. Insofar the shank portion extends fully into the head portion there is almost no pressure applied to the head portion so that there is no risk of the head being displaced from the shank portion since virtually all pressure is between the shank portion of the handle and the Allen wrench. In the event that excessive pressure is applied and the wrench snaps, all of the parts will be retained within the handle with very little risk of any part flying loose therefrom. If it is desirable to turn the wrench around in order to reach a deeply located Allen screw, it is a simple matter to remove the wrench from the handle and insert the short end of the wrench in its passage 18 with the long end thereof extending out through the socket 28.

In practice, it has been found desirable to make the back outer face of the head somewhat concave at 52 in order to provide a position for a thumb when using the tool. The concave cup on the heat assures a firmer and a more positive grip on the handle when using the device to turn screws and the like.

While the invention has been described with particular reference to the illustrated embodiment, numerous modifications thereto will appear to those skilled in the art.

Having thus described the invention, what I claim and desire to obtain by Letters Patent of the United States is:

1. A handle for use with an L-shaped tool, comprising (a) a tubular shank portion formed with an axial passage of a length and width sufficient to accommodate the long leg of said tool, (b) a head mounted to one end of said shank portion and formed with a socket therein open to said head and to one side directly opposite said passage, and, (c) a latch pivotally mounted to said head about an axis perpendicular to said passage and offset to one side thereof whereby said latch may be pivoted in and out of said socket to restrain that portion of said tool located in said socket when said latch is closed and to allow removal of said tool when said latch is open, (d) spring means engaging the inner end of said latch for biasing said latch in either of two operable positions; and (e) a cup trapped between one end of said spring and the rounded end of said latch.

2. A handle according to claim 1 wherein said head is formed with a spring receiving recess at the inner portion of said socket opposite the rounded end of said latch, the axis of said recess being generally parallel to the length of said shank portion.

* * * * *